US011187234B2

(12) United States Patent
Artus et al.

(10) Patent No.: US 11,187,234 B2
(45) Date of Patent: Nov. 30, 2021

(54) WHEEL BLADE FOR TURBOMACHINE, COMPRISING A WINGLET AT ITS TIP AND AT THE LEADING EDGE

(71) Applicant: SAFRAN HELICOPTER ENGINES, Bordes (FR)

(72) Inventors: Fabien Artus, Moissy-Cramayel (FR); Youssef Bouchia, Moissy-Cramayel (FR); Laurent Pierre Tarnowski, Moissy-Cramayel (FR)

(73) Assignee: SAFRAN HELICOPTER ENGINES, Bordes (FR)

( * ) Notice: Subject to any disclaimer, the term of this patent is extended or adjusted under 35 U.S.C. 154(b) by 247 days.

(21) Appl. No.: 16/480,046

(22) PCT Filed: Jan. 25, 2018

(86) PCT No.: PCT/FR2018/050167
§ 371 (c)(1),
(2) Date: Jul. 23, 2019

(87) PCT Pub. No.: WO2018/138438
PCT Pub. Date: Aug. 2, 2018

(65) Prior Publication Data

US 2020/0003219 A1 Jan. 2, 2020

(30) Foreign Application Priority Data

Jan. 27, 2017 (FR) ..... 17 50685

(51) Int. Cl.
*F04D 17/06* (2006.01)
*F01D 5/04* (2006.01)
(Continued)

(52) U.S. Cl.
CPC ..... *F04D 17/06* (2013.01); *F01D 5/04* (2013.01); *F04D 29/30* (2013.01); *F04D 29/68* (2013.01); *F05D 2220/40* (2013.01)

(58) Field of Classification Search
CPC ..... F04D 29/30; F04D 17/06; F04D 29/68; F01D 5/04
See application file for complete search history.

(56) References Cited

U.S. PATENT DOCUMENTS 3,984,193 A 10/1976 Yu
5,437,541 A * 8/1995 Vainrub ..... F04D 29/384 416/223 R
2008/0213098 A1* 9/2008 Neef ..... F01D 5/20 416/223 A

FOREIGN PATENT DOCUMENTS

WO 2010103055 A1 9/2010
WO 2012080669 A1 6/2012

OTHER PUBLICATIONS

Search Report issued in French Patent Application No. 1750685 dated Oct. 5, 2017.

(Continued)

*Primary Examiner* — Eldon T Brockman
*Assistant Examiner* — Michael L Sehn
(74) *Attorney, Agent, or Firm* — Pearne & Gordon LLP

(57) ABSTRACT

A wheel blade for a turbomachine compressor. The blade comprises a body extending between the root of the blade in the direction of the height of the blade. The body extends from a leading-edge to a trailing edge in a direction of the camber line of the blade. The blade comprises a winglet located in the extension of the body in the direction of the height. The winglet is located at the tip of the blade and at the leading edge of the blade. The body has a curvature oriented in a first direction of rotation with respect to the direction of the camber line, the winglet having a curvature (Continued)

in a second direction of rotation counter to the first direction of rotation.

14 Claims, 2 Drawing Sheets

(51) Int. Cl.
*F04D 29/30* (2006.01)
*F04D 29/68* (2006.01)

(56) References Cited

OTHER PUBLICATIONS

International Search Report issued in Application No. PCT/FR2018/050167 dated Apr. 16, 2018.
Written Opinion issued in Application No. PCT/FR2018/050167 dated Apr. 16, 2018.

* cited by examiner

WHEEL BLADE FOR TURBOMACHINE, COMPRISING A WINGLET AT ITS TIP AND AT THE LEADING EDGE

This is the National Stage application of PCT international application PCT/FR2018/050167, filed on Jan. 25, 2018 entitled "WHEEL BLADE FOR A TURBOMACHINE, COMPRISING A WINGLET AT ITS TIP AND AT THE LEADING EDGE", which claims the priority of French Patent Application No. 17 50685 filed Jan. 27, 2017, both of which are incorporated herein by reference in their entirety.

TECHNICAL FIELD

The invention refers to the general technical field of aircraft turbomachines, such as turbine engines. More specifically, the invention refers to centrifugal and/or diagonal compressor wheels for turbomachines.

BACKGROUND OF THE INVENTION

A centrifugal compressor wheel for a turboprop engine of a known structure comprises a base and a plurality of blades that are connected to the base.

Each blade extends from a root to a tip in the height direction of the blade, and from a leading edge to a trailing edge in the direction of the skeleton of the blade. The blade comprises an aerodynamic wall that connects the leading edge to the trailing edge. The blades may be of various shapes.

Some blades of the wheel are referred to as so-called intermediate blades. They are shorter in the direction of the skeleton of the blade than other so-called primary blades and their purpose is to increase the aerodynamic performance of the compressor.

There is a need to further improve the isentropic efficiency of centrifugal compressors for turbomachines.

DISCLOSURE OF THE INVENTION

The invention aims to provide at least a partial solution to the problems encountered in prior art solutions.

In that regard, the invention refers to a wheel blade for a turbomachine compressor. The blade comprises a root and a tip spaced apart from each other in the height direction of the blade.

The blade comprises a body running from the root to the tip in the height direction, and running from a leading edge to a trailing edge in a direction of the skeleton of the blade. The body has a curvature oriented in a first direction of rotation with respect to the direction of the skeleton of the blade.

According to the invention, the blade comprises a winglet located along the extension of the body in the height direction, at the tip of the blade and on the leading edge of the blade. The winglet has a curvature in a second direction of rotation opposite to the first direction of rotation.

Thanks to its specific shape, the blade according to the invention limits the wingtip vortices in the compressor and thereby increases the efficiency thereof. In particular, it limits flow disturbances due to the gap between the blades and the compressor casing.

The invention may optionally comprise one or more of the following features either in combination with each other or not.

Advantageously, the winglet starts at the leading edge and runs in the direction of the trailing edge.

According to an embodiment feature, the length of the winglet in the direction of the skeleton of the blade is between 0% and 100% of the length of the blade in the direction of the skeleton of the blade.

Advantageously, the width of the winglet in the transverse direction of the blade decreases progressively from the leading edge to the trailing edge.

According to an advantageous embodiment, the height of the winglet is between 50% and 100% of the height of the blade.

According to another embodiment feature, the distal end of the winglet forms an angle of between 90° and 180° with the body, according to at least one cutting plane of the body that is substantially perpendicular to the direction of the skeleton of the blade.

Advantageously, the winglet has a concave shape according to at least one cutting plane of the body that is substantially perpendicular to the direction of the skeleton of the blade.

Preferably, the winglet has a twisted-wall shape in relation to the body about a screw axis that is offset transversely in relation to a centre line of the blade in the direction of the skeleton of the blade.

The invention also refers to a wheel for a turbomachine compressor comprising a blade as defined above.

According to an embodiment feature, the wheel comprises primary blades and intermediate blades placed between the primary blades, with at least one of the intermediate blades being a blade as defined above.

According to an advantageous embodiment, the body comprises a lower surface and an upper surface opposite the lower surface in a transverse direction of the blade, with the winglet being oriented toward an upper surface of a primary blade adjacent to the intermediate blade intermediate and in front of which is located the lower surface of the intermediate blade.

The invention also refers to a centrifugal and/or compressor for a turbomachine comprising a wheel as defined above.

Diagonal compressors are also known by the name of mixed flow compressors. These types of compressors have an outlet that is intermediate between an axial outlet of an axial compressor and a radial outlet of a centrifugal compressor.

In addition, the invention refers to a turbomachine comprising a compressor as defined above. The turbomachine is preferably an aircraft turbine engine, such as a turbine engine for a helicopter.

BRIEF DESCRIPTION OF THE FIGURES

The present invention will be more readily understood from a reading of the description of embodiments, given purely as examples and not intended to limit in any way, in reference to the appended drawings, in which.

DETAILED DESCRIPTION OF SPECIAL EMBODIMENTS

Identical, similar, or equivalent parts of the various figures have the same numerical references so as to facilitate the reading of the various figures.

Figure 1:
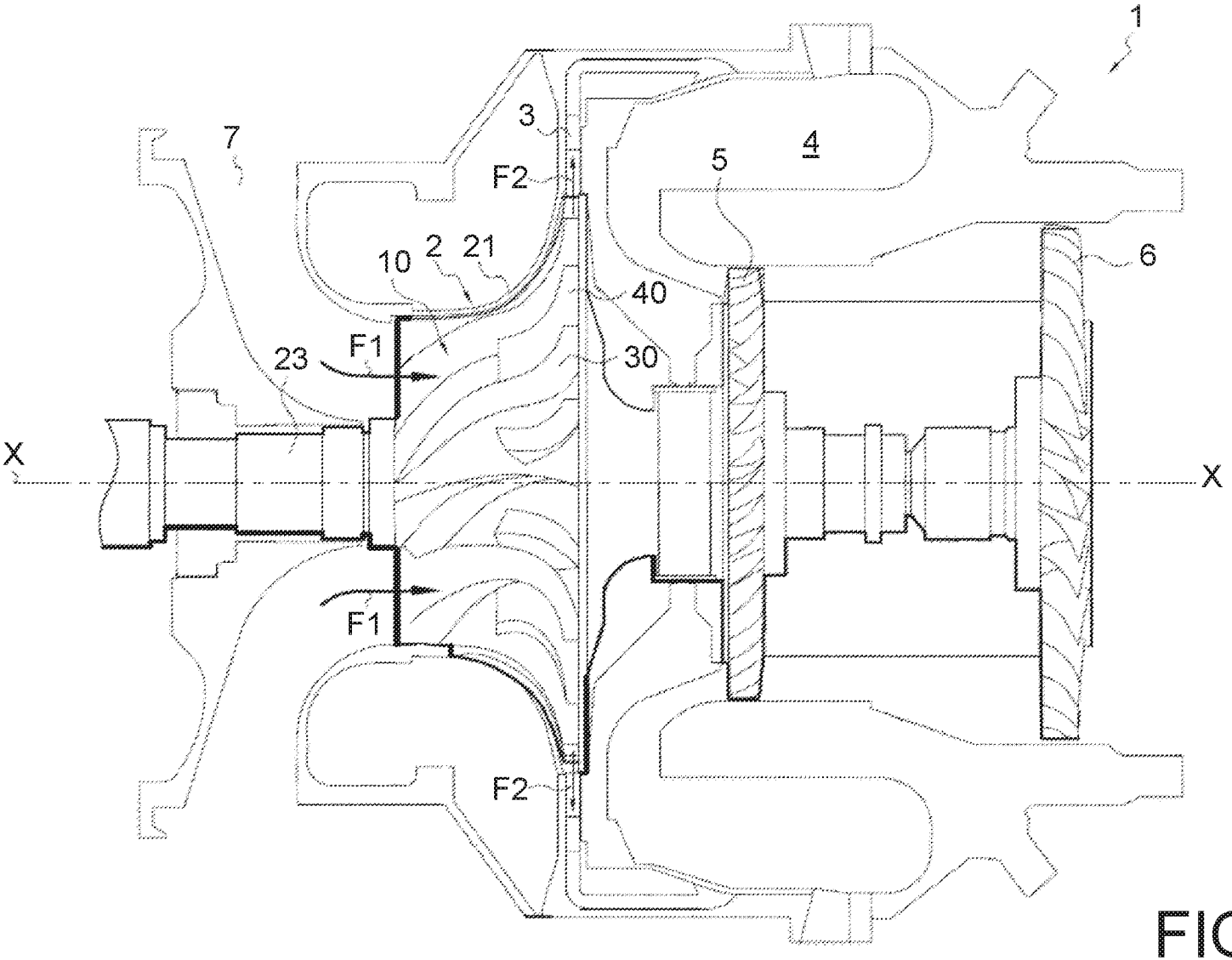
FIG. 1 is a schematic view with a partial longitudinal cross-section of a helicopter turbine engine, according to a first embodiment of the invention.

FIG. 1 shows a helicopter turbine engine 1. The turbine engine 1 is substantially rotationally symmetrical with respect to an axial direction X-X of the turbine engine.

The turbine engine 1 comprises a centrifugal compressor 2 which has a wheel 10. The turbine engine 1 comprises, from upstream to downstream, the diffuser 3, the combustion chamber 4, the high-pressure turbine 5, and the free turbine 6. The compressor 2 and the high-pressure turbine 5 are installed on the shaft 23 which lies substantially along axial direction X-X. The free turbine 6 is installed on a shaft that is coaxial with the shaft 23.

The upstream and downstream directions are used in this document in reference to the overall flow of gases in the turbine engine; such a direction is also termed axial. A radial direction is a direction that is substantially perpendicular to axis X-X of the turbine engine and cutting across said axis.

The turbine engine 1 has an air inlet 7; air passes through this inlet to reach the compressor 2.

The rotation of the wheel 10 about its axis of rotation X-X draws the air upstream of the wheel 10 and the speed of the fluid passing through the wheel 10 is progressively converted into radial speed, with the fluid exiting on the outer periphery of the wheel 10. Air enters the wheel 10 in a direction that is rather parallel to the axis of rotation X-X of the wheel, which is shown in the cross-section of FIG. 1 by arrows F1, and exits the wheel 10 in a radial direction perpendicular to axis A, as shown by arrows F2.

The air exiting wheel 10 passes through the diffuser 3 before reaching the combustion chamber 4. The combustion gases exiting the chamber 4 cause high-pressure the turbine 5 and the free turbine 6 to rotate, which in turn cause the shaft 23 of the compressor 2 to rotate about its axis X-X, as well as the coaxial shaft on which the free turbine 6 is installed.

This compressor 2 comprises the centrifugal wheel 10 and a casing 21 externally surrounding the blades 30 and 40 of the wheel 10.

Figure 2:
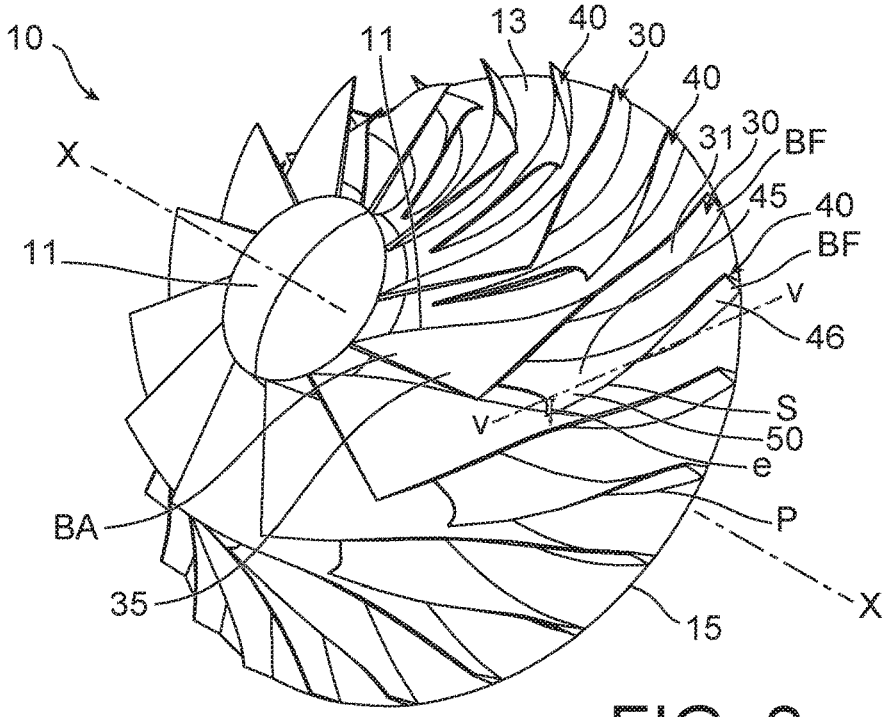
FIG. 2 is a partial perspective view of the centrifugal compressor wheel of the turbomachine according to the first embodiment.

In reference to FIG. 2, the wheel 10 comprises a flared base 13 and the blades 30 and 40 which are rigidly secured to the base 13. The base 13 is flared in the downstream direction as it extends radially from a hub 11 to a circumferential edge 15. The downstream part of the wheel 10 is closed off by a radial flange that is rigidly secured to the base 13.

Each of the blades 30 and 40 of the wheel extends from upstream to downstream from a leading edge BA to a trailing edge BF in a direction of the skeleton of the blade S-S. This direction of the skeleton of the blade S-S is curved and corresponds to the centre line of the blade in the transverse direction Z-Z of the blade, which connects leading edge BA to trailing edge BF. This is the longitudinal direction of the blades 30 and 40.

The trailing edge BF of the blades is located in the vicinity of the circumferential edge 15 in relation to the axis of rotation X-X.

Each of the blades 30 and 40 also run in the direction of the height thereof Y-Y from a root P, where the blade is mechanically connected to the base 13, to the tip S thereof.

The blades 30 and 40 comprise the primary blades 30 and the intermediate blades 40, which are placed between the primary blades 30 about the axis of rotation X-X of the compressor.

The primary blades 30 have a greater length in the direction of the skeleton of the blade S-S than the intermediate blades 40. Leading edge BA of the primary blades 30 is located more upstream than the leading edge of the intermediate blades 40.

Each primary blade 30 comprises a single wall comprising a lower surface 31 and an upper surface 35 opposite the lower surface in a transverse direction of the blade. The lower surface 31 and the upper surface 35 both connect the leading edge BA of the blade to the trailing edge BF thereof. The primary blades 30 are twisted.

Each intermediate blade 40 also comprises an upper surface 45 and a lower surface 46, both of which connecting the leading edge BA of the blade to the trailing edge BF thereof. The upper surface 45 of each intermediate blade 40 is in front of the lower surface 31 of one of the adjacent primary blades 30. The lower surface 46 of each intermediate blade is in front of the lower surface 35 of one of the adjacent primary blades 30.

Figure 3:
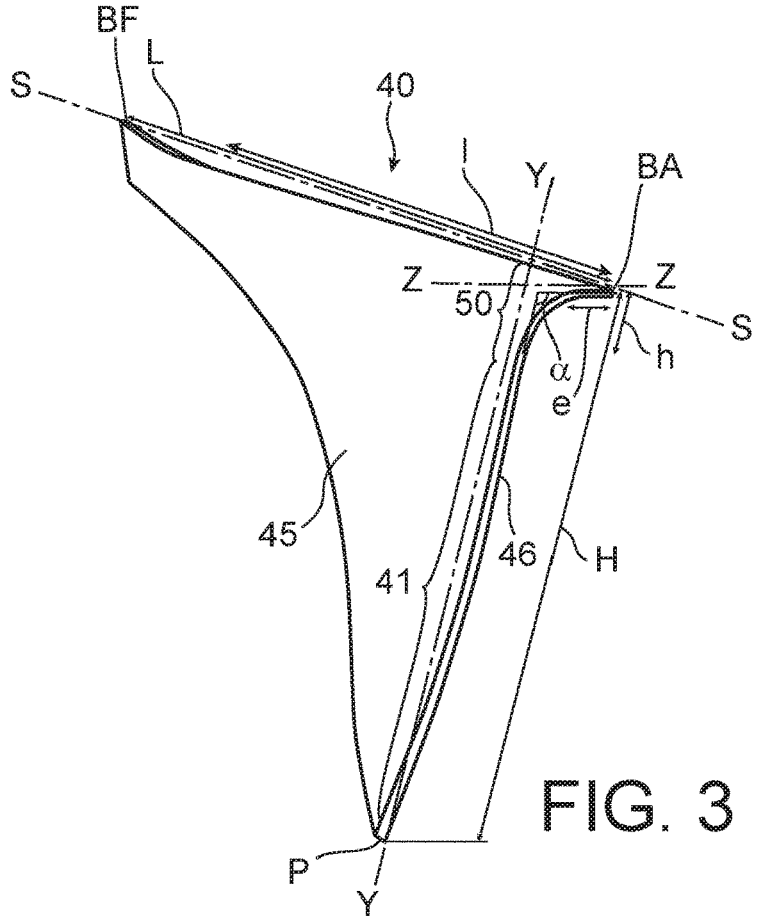
FIG. 3 is a partial perspective view of an intermediate blade of the turbomachine wheel according to the first embodiment.

In reference to both FIGS. 2 and 3, each intermediate blade 40 comprises a body 41 which runs from the root P of the blade toward the tip S of the blade, as well as a winglet 50 that is located along the extension of the body in the height direction Y-Y and includes the tip S of the blade.

The body 41 corresponds to a lower aerodynamic portion of the blade 40. The winglet 50 corresponds to an upper aerodynamic portion of the blade 40.

The body 41 runs from the leading edge BA of the blade to the trailing edge BF thereof in the direction of the skeleton of the blade S-S.

The winglet 50 starts at the leading edge BA of the blade and runs in the direction of the trailing edge BF according to the direction of the skeleton of the blade S-S.

The body 41 and the winglet 50 together form a single and unitary wall of the blade 40 which includes the upper surface 45 of the blade and the lower surface 46 thereof, which is opposite the upper surface 45 in the transverse direction Z-Z of the blade.

The transverse direction Z-Z is a direction that is perpendicular to the direction of the skeleton of the blade S-S and to the height direction Y-Y of the blade. It corresponds to the width direction of the blade 40.

The body 41 has a general twisted shape on the upper surface 45 with a non-zero curvature in a first direction that is oriented in front of the lower surface 46 in the transverse direction Z-Z.

The winglet 50 has a curved shape in relation to the body 41. The curvature thereof is greater than that of the body.

The winglet 50 has a curvature oriented toward the lower surface 46 of the blade in the transverse direction Z-Z. It has a curvature in a second direction opposite to the first direction, that is, in a direction opposite that of the curvature of the upper surface 45 at the body 41.

The winglet 50 has the shape of a portion of twisted wall in relation to the body 41 about a screw axis V-V, which is substantially parallel to the direction of the skeleton of the blade S-S and which is offset transversely with respect to the centre line of the blade 40 in the direction of the skeleton of the blade S-S.

It has a concave shape according to at least one cutting plane of the body 41 that is substantially perpendicular to the direction of the skeleton of the blade S-S. The distal end of the winglet forms an angle α of between 90° and 180° with respect to the body 41 in this plane.

The length l of the winglet 50 in the direction of the skeleton of the blade S-S is between 0% and 100% of the length L of the blade 40 in the direction of the skeleton of the blade S-S.

The height h of the winglet 50 is between 50% and substantially 100% of total the height H of the blade.

The winglet 50 has a width e that decreases in the direction of the skeleton of the blade S-S from the leading edge BA to the trailing edge BF. The maximum width e of the winglet 50 is between 1% and 30% of the length L of the blade.

The winglet 50 limits the wingtip vortices in the compressor 2, particularly at the tip S of the blade, which thus increases the isentropic efficiency of the compressor 2.

In particular, the intermediate blades 40 limit the flow disturbances of the gases in the compressor 2 due to the gap between the blades 30 and 40 and the casing 21 of the compressor.

Naturally, a person skilled in the art may make various modifications to the invention described above, without exceeding the scope of the described invention.

In particular, the general shape, dimensions, and curvature of the winglet 50 may vary from those shown in FIGS. 2 and 3.

Furthermore, at least some of the primary blades 30 may include a winglet 50 in addition to or instead of the intermediate blades 40.

What is claimed is:

1. A wheel blade for a compressor of a turbomachine, comprising:

a root and a tip that are spaced apart from each other in a height direction of the blade, and a body running from the root to the tip in the height direction and running from a leading edge to a trailing edge in a direction of a skeleton of the blade, wherein the blade comprises a winglet located along an extension of the body in the height direction, at the tip of the blade and on the leading edge of the blade, wherein the body has a curvature oriented in a first direction of rotation about a direction parallel to the direction of the skeleton of the blade, and wherein the winglet has a curvature solely in a second direction of rotation that is opposite the first direction of rotation, and wherein the winglet has a twisted-wall shape in relation to the body about a screw axis, the screw axis being offset transversely with respect to a centre line of the blade in the direction of the skeleton of the blade.

2. The wheel blade according to claim 1, wherein the winglet starts at the leading edge and extends in the direction of the trailing edge.

3. The wheel blade according to claim 1, wherein a length of the winglet in the direction of the skeleton of the blade is between 0% and 100% of a length of the blade in the direction of the skeleton of the blade.

4. The wheel blade according to claim 1, wherein a width of the winglet in the transverse direction of the blade gradually decreases from the leading edge to the trailing edge.

5. The wheel blade according to claim 1, wherein a height of the winglet is between 50% and 100% of a height of the blade.

6. The wheel blade according to claim 1, wherein the distal end of the winglet forms an angle of between 90° and 180° with the body, according to at least one cutting plane of the body that is substantially perpendicular to the direction of the skeleton of the blade.

7. The wheel blade according to claim 1, wherein the winglet has a concave shape according to at least one cutting plane of the body that is substantially perpendicular to the direction of the skeleton of the blade.

8. A wheel for a centrifugal and/or diagonal compressor of a turbomachine, comprising the wheel blade according to claim 1.

9. The wheel according to claim 8, comprising primary blades and intermediate blades placed between the primary blades, wherein at least one of the intermediate blades is said wheel blade.

10. The wheel according to claim 8, wherein the body comprises a lower surface and an upper surface opposite the lower surface in a transverse direction of the wheel blade, wherein the winglet is oriented toward an upper surface of a primary blade adjacent to an intermediate blade.

11. The wheel according to claim 10, wherein the winglet is oriented toward the upper surface of the primary blade adjacent to the intermediate blade and in front of which is located the lower surface of the intermediate blade.

12. A centrifugal and/or diagonal compressor for a turbomachine comprising the wheel according to claim 8.

13. A turbomachine comprising the compressor according to claim 12.

14. The turbomachine according to claim 13, wherein the turbomachine is a helicopter turbine engine.

* * * * *